US005329865A

United States Patent [19]

McWard

[11] Patent Number: 5,329,865

[45] Date of Patent: Jul. 19, 1994

[54] SECURITY BOX ASSEMBLY ADAPTED TO BE MOUNTED BENEATH AN UNDERSURFACE

[76] Inventor: Jeffrey McWard, Rte. 3 - Box 66, Taylorville, Ill. 62568

[21] Appl. No.: 968,827

[22] Filed: Oct. 30, 1992

[51] Int. Cl.[5] ..... E05G 1/04

[52] U.S. Cl. ..... 109/50; 70/63; 70/159; 70/162; 70/278; 108/93; 109/59 R; 109/69; 220/335; 248/553; 292/127; 312/24; 312/242

[58] Field of Search ..... 70/63, 278, 158-162, 70/DIG. 63; 109/50, 59 R, 69, 70, 45, 47; 292/127, 227, 201; 5/308, 931; 220/335; 312/242, 24, 27, 222; 108/93, 26, 143; 248/551, 553, 205.3

[56] References Cited

U.S. PATENT DOCUMENTS

| | | | |
|---|---|---|---|
| 883,305 | 3/1908 | Fetch | 312/27 |
| 3,464,606 | 9/1969 | Nordeen | 312/242 X |
| 3,722,973 | 3/1973 | Textoris | 312/27 X |
| 3,842,936 | 10/1974 | De Luca | 108/26 X |
| 4,651,544 | 3/1987 | Hungerford | 70/279 X |
| 4,941,718 | 7/1990 | Alexander, III et al. | 312/27 X |
| 4,971,390 | 11/1990 | McGinley | 5/308 X |
| 5,042,770 | 8/1991 | Louthan | 248/205.3 X |
| 5,056,342 | 10/1991 | Prinz | 70/63 |

FOREIGN PATENT DOCUMENTS

| | | | |
|---|---|---|---|
| 63515 | 1/1913 | Switzerland | 70/DIG. 63 |

*Primary Examiner*—Lloyd A. Gall

*Attorney, Agent, or Firm*—McCaleb, Lucas & Burgman

[57] ABSTRACT

A security box assembly has a body portion and a cover portion. The cover portion has a top wall with hook and loop type fastener sheets for adhering the box to the undersurface of a table or counter, and has depending walls defining a downwardly open hollow interior. The body portion has a bottom wall with upstanding walls defining an upwardly open hollow interior. The body portion is moveable to and from a closed, locked position against the underside of the cover portion, in which portion the upwardly and downwardly facing openings are in registration. A parallelogram linkage system consisting of pairs of parallel pivoted links on each side of the assembly connect the side walls of the body portion with side walls of the cover portion thereby enabling the body portion to move downwardly and forwardly from the closed, locked position to an open position providing ready access to the interior of the body portion. Latch members are pivotally mounted in the cover portion and engage catch members in the body portion in the closed, locked position. An external electronic combination touch pad actuates a solenoid to disengage the latches from the catches, thereby enabling the body portion to move to the open position by gravity, assisted by spring biasing members.

13 Claims, 3 Drawing Sheets

SECURITY BOX ASSEMBLY ADAPTED TO BE MOUNTED BENEATH AN UNDERSURFACE

BACKGROUND OF THE INVENTION

This invention belongs to the field of security boxes adapted to be mounted to the undersurface of a table, nightstand, counter or the like in a substantially out-of-sight location, yet readily accessible to an authorized person having the proper combination code, or a key, for the safe storage of firearms, prescription medicines, valuables, or other items.

There is an alarming increase in burglaries, robberies, and home invasions directed at residences, and a corresponding increase in the number of handguns and other weapons which are kept by homeowners for the protection of their families. There is a very real danger of keeping loaded handguns and other weapons where they are accessible to children or adults who are untrained in their use. For this reason a homeowner may often store a handgun where it is not readily accessible when needed, or store it or the ammunition for it where it would not be immediately accessible in case of need. The purpose of having a handgun is of course defeated if it cannot be reached quickly, ready for immediate use.

Home burglaries and invasions occur most frequently at night when families are asleep, so a handgun should be kept in a location where it can be reached near the sleeping area during an emergency. One such location would be under the top of a night table; for other reasons, including the frequency that family members are in a kitchen area at all hours, another useful location for a handgun would be under a countertop in or near the kitchen area.

Some prescription and non-prescription drugs can be dangerous to small children and even to some adults, so another use for such a security box would be to store medicines. A still further use would be to store jewelry and other valuables, requiring access only to qualified individuals.

SUMMARY OF THE INVENTION

The invention relates generally to a security box assembly that has an electrically or electronically powered combination lock, preferably with a key override in event of failure of the electrical power source, adapted to be mounted substantially out-of-sight beneath a horizontal undersurface, such as commonly found in tables, night stands, and counter tops in a home.

In the preferred embodiment which is described, the security box assembly has an upwardly open body portion and a downwardly open cover portion with front, back and side walls which are in registration to define a hollow interior for the safe storage of a handgun and other items, and where access must be denied to unauthorized persons but access must be readily permitted to qualified persons who have a combination code, or a key.

An important feature of the invention is a parallelogram linkage comprising pairs of double pivoted links connecting the side walls of the lower, body portion of the box to the corresponding side walls of the upper, cover portion. This enables the lower body portion, with the handgun, medication, valuables, or whatever, to move downwardly and forwardly from a relatively out-of-sight location to a readily accessible location.

BRIEF DESCRIPTION OF THE DRAWINGS

Other objects and advantages will be apparent from the following description taken in connection with the accompanying drawings in which.

Like parts are referred to by like reference characters.

DESCRIPTION OF THE PREFERRED EMBODIMENT

Figure 2A:
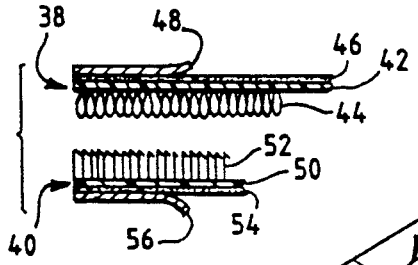
FIGS. 2A is a fragmentary, enlarged, exploded view of FIG. 2 showing sheets of hook and loop material illustrated for securing the security box assembly to the undersurface of the table top.

Referring now to the specific embodiment of the invention in the drawings, a security box assembly is generally described 20. It comprises a hollow, upwardly open body portion 22 and a hollow downwardly open cover portion 24.

Figure 5:
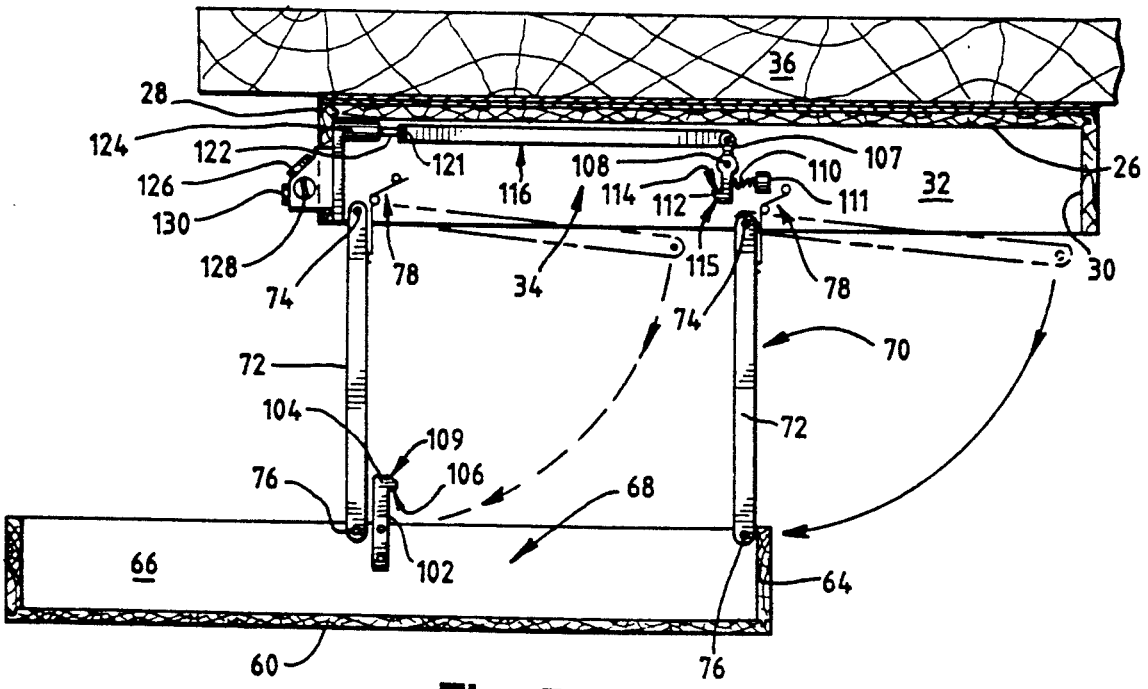
FIG. 5 is a view similar to FIGS. 2 and 3 showing the security box assembly in fully opened, accessible position.

The cover portion 24 comprises a rectangular top wall 26 with a depending front wall 28, back wall 30, and opposite side walls 32, 32. These depending walls define a downwardly facing opening 34 (FIG. 5).

The cover portion 24 is secured to the undersurface of a tabletop or countertop 36, far enough back from the edge to be substantially out of sight to the casual observer. In the embodiment illustrated the cover portion is adhered to the undersurface by releasable, mutually adherent loop and hook type fastener sheets 38 and 40 (FIG. 2A), sometimes referred to in the trade as "VELCRO" and is described in detail in U.S. Pat. Nos. 2,714,437; 3,009,235 and 3,562,044.

Figure 2:
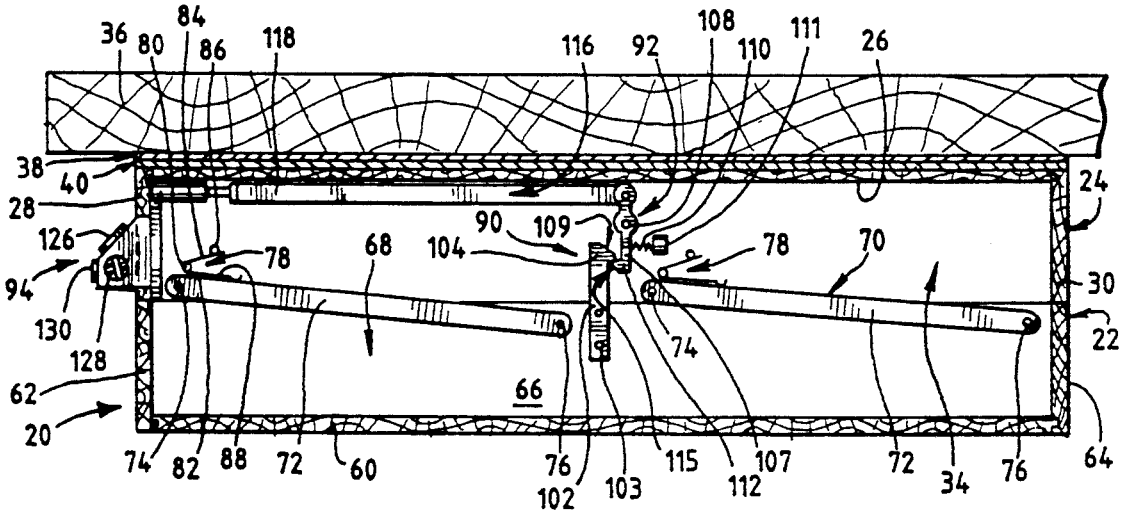
FIG. 2 is a fragmentary enlarged cross sectional view of FIG. 1 taken along line 2—2.

These are best shown in FIGS. 2 and 2A. Loop type fastener sheet 38 comprises a mounting sheet 42 with loop-like fiber elements 44 extending from one side and a pressure-sensitive adhesive layer 46 and a peel-off protective sheet 48 on the opposite side.

Hook type fastener sheet 40 comprises a mounting sheet 50 with hook-type fiber elements 52 extending from one side, and a pressure-sensitive adhesive layer 54 and a peel-off protective sheet 56 on the opposite side.

These loop-like and hook-type fiber elements 44 and 52 may be reversed. They are pressure-sensitive in that they cling and adhere tightly to one another in a well known manner when pressed together but may be repeatedly, manually separated by simply pulling them apart.

As part of the assembly process, the hook-type fastener sheet 38 is secured to the undersurface of table-top 36 by pressing the adhesive layer 46 against it after peeling off the protective sheet 48. Likewise, the loop-type fastener sheet 40 is secured to the top wall 26 of the cover portion 24 by pressing the adhesive layer 54 against it after peeling off the protective sheet 56.

The body portion 22 comprises a rectangular bottom wall 60 with an upstanding front wall 62, back wall 64, and opposite side walls 66, 66. These upstanding walls define an upwardly facing opening 68 (FIG. 6).

Figure 1:
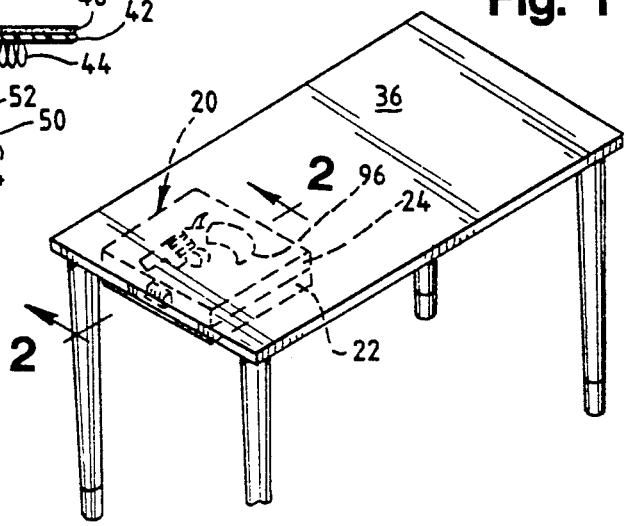
FIG. 1 is a perspective view of a table with a security box assembly according to the present invention mounted substantially out-of-sight beneath the table top near a forward edge.
Figure 6:
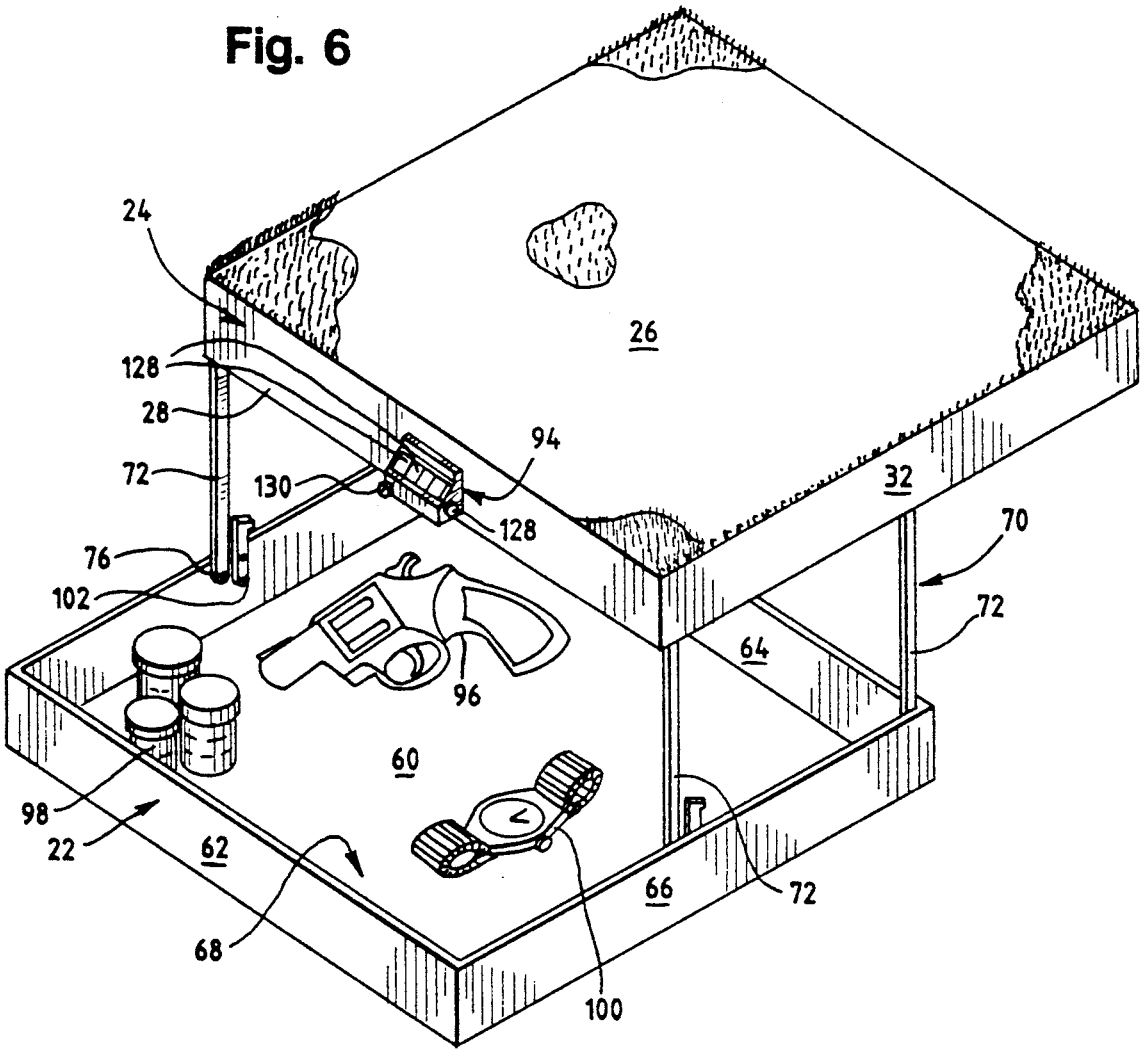
FIG. 6 is a fragmentary perspective view of the fully opened security box assembly shown in FIG. 5.

An important part of the present invention is that the body portion 22 is supported beneath the cover portion by a parallelogram linkage generally designated 70 enabling the body portion to move between a rear, out-of-sight, upper, closed, locked position shown in FIGS. 1 and 2, and a forward, readily-accessible, lower, open, unlocked position shown in FIGS. 5 and 6.

Figure 3:
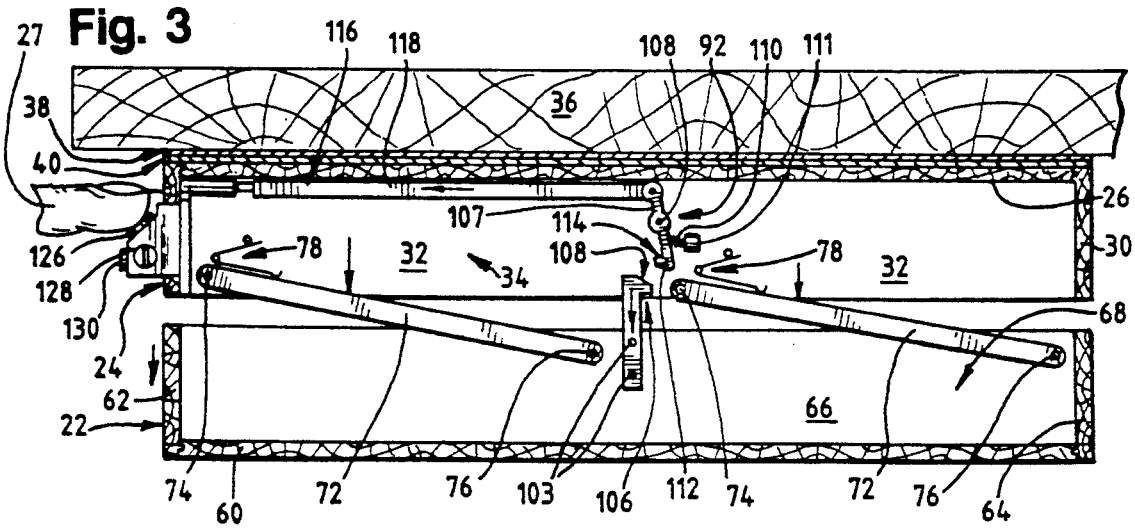
FIG. 3 is a view similar to FIG. 2 showing the security box assembly in an intermediate opened position.

As used here, the term "parallelogram linkage" follows the engineering definition of a parallelogram, namely "a four sided plane figure with opposite sides parallel." Such four sided plane figure is illustrated in FIGS. 2, 3 and 5 where two of the opposite sides would be lines (not shown) intersecting the axes of pivot pins 74, 76 of the front and back links 72, 72. Those lines are parallel in all positions. Likewise, the other two opposite sides would be horizontal lines (not shown) intersecting the axes of pivot pins 74, 74 on the cover portion 24, and the axes of pivot pins 76, 76 on the body portion 22.

The parallelogram linkage 70 comprises a pair of links 72 of identical length connecting each side wall 66 of the body portion to a corresponding side wall 32 of the cover portion enabling the body portion to swing downwardly and forwardly to the open, unlocked position described above.

Each link 72 is pivoted on pivot posts 74 and 76 to the cover and body portions respectively. A formed wire spring 78 comprises an intermediate coiled section 80 mounted on a pivot post 82 on a corresponding side wall 32. One leg 84 of each spring 78 is held by another post 86 on sidewall 32, and an opposite spring leg 88 engages a corresponding link 72. The four springs 78 urge the four links 72 clockwise about the respective pivot posts 74, thereby assisting gravity in biasing the body portion 22 toward the open, forwardly disposed, fully accessible position shown in FIGS. 5 and 6.

Locking mechanism generally designated 90 is provided within the box to hold the body portion 22 in the closed, locked position shown in FIG. 2. Releasing mechanism generally designated 92 and actuated by an external electronic key pad assembly 94 enable movement of the body portion 22 from the closed, locked position of FIG. 2 to the open, forwardly disposed position of FIGS. 5 and 6 to enable ready access to a hand gun 96, medication 98 or valuable jewelry item 100 as will now be described.

In the embodiment disclosed, the locking mechanism 90 comprises a catch member 102 which is fixed, as by rivets 103, to the inside surface of each body portion side wall 66. Each catch member has a head portion 104 comprising a downwardly facing detent surface 106 (FIG. 3) and an upper diagonal cam surface 109.

The releasing mechanism 92 comprises a movable latch 107 pivoted on a post 108 on the inside of each cover portion side wall 32. A small, biasing coil spring 110 is seated in a cup 111 on each wall 32 to urge the movable latch 107 in a clockwise direction about a respective post 108. Each movable latch 107 has a head 112 with an upwardly facing detent surface 114 (FIG. 5) and a lower diagonal cam surface 115 which is engageable with cam surface 109 on the corresponding catch member 102 when the body section 22 is moved to the locking position as will be explained.

Figure 4:
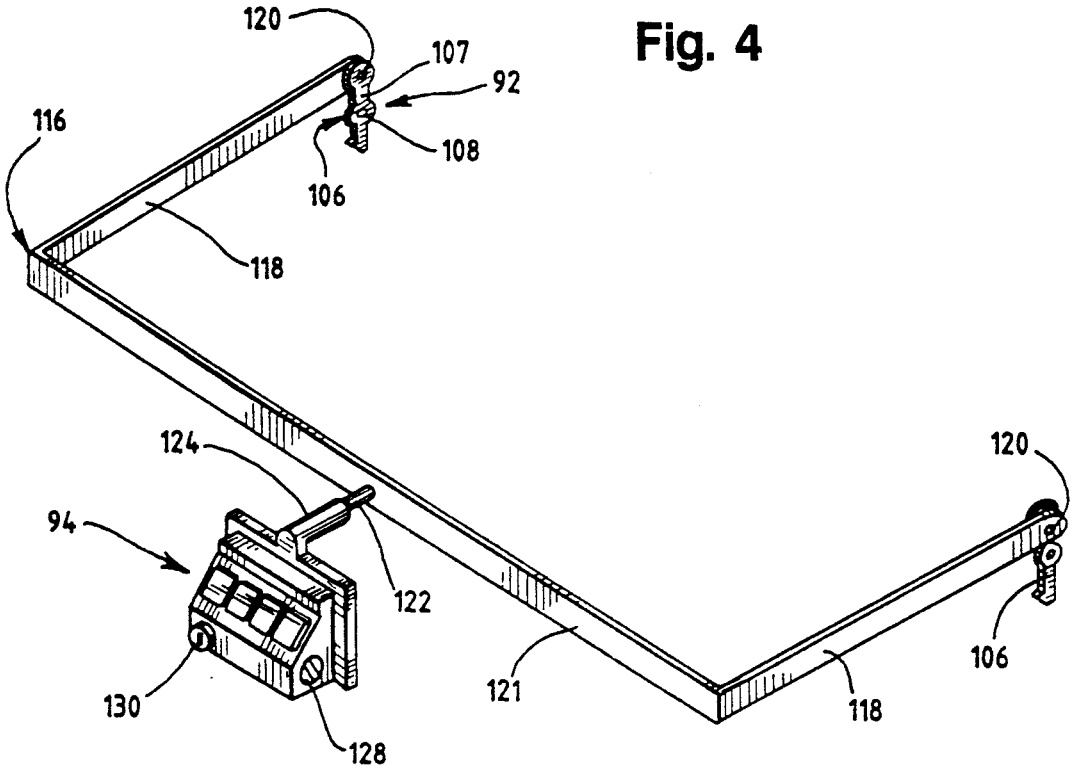
FIG. 4 is a fragmentary perspective enlarged view of combination locking and releasing mechanisms and latch mechanism shown in FIGS. 2 and 3.

The two releasing mechanisms 92 are interconnected for simultaneous unlocking movement by a bifurcated draw bar mechanism 116 which is best shown in FIG. 4. This comprises a pair of draw bars 118 pivotally connected to the tops of movable latches 107 by pivot pins 120. The draw bars are interconnected by a cross bar 121 to an axial armature or plunger 122 of a solenoid 124 which, in the present example, is an integral part of the housing for key pad assembly 94.

The key pad assembly 94 and solenoid 124 may be similar to those used in keyless entry systems in certain automobiles for instances those currently manufactured by Ford Motor Company, so the internal operating circuitry will not be shown or described in detail. Briefly, however, there is a plurality of (in this case, four) key pad buttons 126 operating an internal circuit (not shown) and which is electrically powered by a battery (not shown) in a compartment beneath screw cap 128. When buttons 126 are pressed by an operator 127 in the correct combination sequence known only to an authorized person, the solenoid 124 will be actuated to draw plunger 122 forwardly. This will swing both movable latches 107 simultaneously, disengaging their detent surfaces 114 from detent surfaces 106 on the catch members 102.

This will release the body portion 22 from the cover portion 24, enabling the body portion to swing downwardly and forwardly, under the urgence of gravity and springs 78, beginning as shown in FIG. 3, to the fully open position of FIGS. 5 and 6 where the items 96, 98 and 100 given as examples above will be readily accessible to any authorized person.

In case of battery or circuit failure a key may be inserted in lock cylinder 130 to retract the plunger 122 and actuate the releasing mechanism 92 by suitable manual unlocking mechanism (not shown).

The embodiment described and shown to illustrate the present invention has been necessarily specific for purposes of illustration. Alterations, extensions and modifications would be apparent to those skilled in the art. The aim of the appended claims, therefore, is to cover all variations included within the spirit and scope of the invention.

The embodiments of the invention in which an exclusive property or privilege is claimed are defined as follows:

1. A security box assembly adapted to be mounted substantially out of sight beneath a horizontal undersurface comprising:

a box comprising a hollow, upwardly open body portion and a hollow, downwardly open cover portion;

the cover portion comprising a top wall with depending side walls and front and back walls defining a hollow interior with a downwardly facing opening;

means for securing the cover portion to an undersurface;

the body portion comprising a bottom wall with upstanding side walls and front and back walls defining a hollow interior with an upwardly facing opening having a continuous upper peripheral edge and being movable to and from a closed, locked position against the cover portion;

the cover and body portions being so structured that, in said closed, locked position, the bottom and top peripheral edges of the body and cover portions are respectively in abutting relationship and the side walls and front and back walls of the cover and body portions are respectively in vertical, co-planar relationships;

locking mechanism secured to the box for holding the body portion in the closed, locked position;

releasing mechanism secured to the box and structured to release the locking mechanism to enable movement of the body portion from the closed, locked position to an open position enabling access to the hollow interior; and a linkage on each side of the box comprising a pair of links horizontally spaced apart along each side of the body portion, each link having opposite ends thereof pivotally connected respectively to the corresponding side walls of the body portion and cover portion.

2. A security box assembly according to claim 1 in which all the links have identical lengths.

3. A security box assembly according to claim 1 in which the box has a front wall, said locking mechanism acts between the body portion and cover portion, and the releasing mechanism is supported on the front wall of the box and is connected to the locking mechanism to release the locking mechanism in response to actuation of the releasing mechanism.

4. A security box assembly according to claim 3 in which the locking mechanism comprises at least one stationary catch with a detent surface mounted said body portion and a movable latch engageable with the detent surface is mounted on the cover portion, and said releasing mechanism is connected to the latch to disengage the latch from the stationary catch in response to actuation of the releasing mechanism.

5. A security box assembly according to claim 4 in which there are at least two of said locking mechanisms, one on each side of the cover portion.

6. A security box assembly according to claim 1 in which the releasing mechanism comprises an electronic combination lock on the cover portion and a solenoid on the cover portion actuatable in response to entering a predetermined combination in said lock to release the locking mechanism.

7. A security box assembly according to claim 6 in which said electronic combination lock includes a plurality of operating buttons arranged in a linear configuration for quick entry of a numbered combination by feel alone and without visual observation.

8. A security box assembly according to claim 1 in which the means for securing the cover portion to an undersurface is an adhesive material on the top surface of the cover portion.

9. A security box assembly according to claim 1 in which the means for securing the cover portion to an undersurface includes sheets of mutually adherent hook and loop materials.

10. A security box assembly according to claim 1 in which the body portion is movable downwardly from the cover portion by gravity in response to operation of said releasing mechanism.

11. A security box assembly adapted to be mounted substantially out of sight beneath a horizontal undersurface comprising:

a box comprising a hollow, upwardly open body portion and a hollow, downwardly open cover portion;

the cover portion comprising a rectangular top wall with depending front, back and side walls defining a hollow interior with a downwardly facing opening;

means securing the cover portion to a horizontal undersurface the body portion comprising a rectangular bottom wall with upstanding front, back and side walls defining a hollow interior with an upwardly facing opening and being movable to and from a closed, locked position against the underside of the cover portion in which the upwardly and downwardly facing openings are in registration;

latch means acting between the body and cover portions for holding the body portion in the closed, locked position, comprising at least one latch member movably mounted on one of said box portions, and at least one catch member mounted on the other of said box portions for engagement with the latch member in the closed, locked position;

manually operable latch release means acting between the front wall of the cover portion and the latch means to release the latch means to allow movement of the body portion between the closed, locked position and an open position enabling ready access to the hollow interior of the body portion; and a pair of pivoted links connecting each side wall of the body portion to a corresponding side wall of the cover portion enabling the body portion to swing downwardly and forwardly to said open position.

12. A security box assembly adapted to be mounted substantially out of sight beneath a horizontal undersurface comprising:

a box comprising a hollow, upwardly open body portion and a cover portion;

means for securing the cover portion to an undersurface;

the body portion comprising a bottom wall with upstanding front, back and side walls defining a hollow interior with an upwardly facing opening and being movable to and from a closed, locked position against and in registration with the underside of the cover portion;

locking mechanism acting between the body portion and cover portion for holding the body portion in the closed, locked position, said locking mechanism comprising at least one stationary catch mounted on a side wall of the body portion and having a stationary detent surface thereon;

releasing mechanism acting between the body portion and cover portion for releasing the body portion from the closed, locked position, said releasing mechanism comprising at least one moveable latch pivoted on one side of the cover portion and having a moveable detent surface disengageable from the stationary detent surface on the stationary catch in response to actuation of the releasing mechanism, and means secured to the front of the cover portion for actuating the releasing mechanism; and linkage comprising pivoted link means connecting each of the side walls to a corresponding side of the cover portion enabling the body portion to swing downwardly and forwardly to the open position.

13. A security box assembly adapted to be mounted substantially out of sight beneath a horizontal undersurface comprising:

a box comprising a hollow, upwardly open body portion and a cover portion;

means for securing the cover portion to an undersurface;

the body portion comprising a bottom wall with upstanding side walls defining a hollow interior with an upwardly facing opening and being movable upwardly to a closed, locked position against and in registration with the underside of the cover portion;

locking mechanism secured to the box for holding the body portion in the closed, locked position;

releasing mechanism secured to the box and structured to release the locking mechanism to enable movement of the body portion from the closed, locked position to an open position enabling access to the hollow interior;

said body portion being movable downwardly from the cover portion by gravity in response to operation of said releasing mechanism;

pivoted link means connecting each of the side walls to a corresponding side of the cover portion enabling the body portion to swing downwardly and forwardly to the open position; and spring biasing means, urging said pivoted link means in a direction to move said body portion toward its said open position.

* * * * *

UNITED STATES PATENT AND TRADEMARK OFFICE

CERTIFICATE OF CORRECTION

PATENT NO. : 5,329,865

DATED : July 19, 1994

INVENTOR(S) : Jeffrey McWard

It is certified that error appears in the above-identified patent and that said Letters Patent is hereby corrected as shown below:

Col. 5, line 12, after "interior; and" a new paragraph should start;

Col. 5, line 29, after "mounted" insert -- on --;

Col. 6, line 25, after "portion; and" a new paragraph should start.

Signed and Sealed this

Twenty-first Day of February, 1995

Bruce Lehman

*Attest:*

BRUCE LEHMAN

*Attesting Officer*

*Commissioner of Patents and Trademarks*